United States Patent [19]

Soerjohadikusumo

[11] 4,343,123

[45] Aug. 10, 1982

[54] COMPOSITE BRIDGE WITH PRECOMPRESSION SYSTEM

[76] Inventor: Roosseno Soerjohadikusumo, 14 Diponegoro St., Jakarta, Indonesia

[21] Appl. No.: 149,444

[22] Filed: May 13, 1980

[30] Foreign Application Priority Data

Jul. 16, 1979 [ID] Indonesia ..... PP/7160

[51] Int. Cl.[3] ..... E04C 3/10

[52] U.S. Cl. ..... 52/225; 52/741; 29/446

[58] Field of Search ..... 52/225, 223 R, 741; 14/73; 29/446

[56] References Cited

U.S. PATENT DOCUMENTS 3,103,026 9/1963 Hahn ..... 52/223 R

*Primary Examiner*—Carl D. Friedman

*Attorney, Agent, or Firm*—Christie, Parker & Hale

[57] ABSTRACT

A composite bridge structure having a precompressed beam for supporting loads thereon is described. A plurality of spaced apart consoles are secured to the beam, the consoles being urged apart to create a bending moment in the beam having a substantially parabolic distribution between the ends of the beam. The bending moment is in a direction opposite to the direction of the moment created by the loads supported by the beam. As a consequence of the precompression, a longitudinal force and bending moment working on the composite bridge structure improves the load carrying capacity of the structure.

21 Claims, 21 Drawing Figures

COMPOSITE BRIDGE WITH PRECOMPRESSION SYSTEM

BACKGROUND OF THE INVENTION

This invention relates to precompression composite bridge construction and more particularly, to a composite structure having concrete slabs secured to supporting steel beams, the concrete slabs being urged apart to thereby create prestressing in the beams prior to moving traffic or "live-load" loading. The "efficiency" of the bridge structure, i.e., utilization of structural members that comprise the bridge, as measured by the load carrying capacity of the bridge with and without prestressing taught by the invention is thereby increased.

Prestressing structural members, such as concrete structures, are known in the prior art. For example, in prestressed concrete structures, high tensile strength steel cables under a tensile stress are embedded in concrete structures. The tensile stress in the steel cable is transferred to the concrete and converted into a compressive force within the concrete. Thus, the prestress in a concrete structure is as a consequence of an internal force under which the concrete reacts.

The present invention differs from the prior art in that the stressing is a result of an external force applied to the composite structure. The manner and effect of the externally applied force that provides the prestress in the composite structure of this invention increases the "efficiency" of the bridge structure over those of the prior art.

SUMMARY OF THE INVENTION

Briefly stated, the composite bridge structure of this invention includes a beams for supporting both "dead loads" and "live loads". A plurality of spaced apart consoles are secured to the upper surface of the beams and are urged apart for creating a bending moment in the beams that is in a direction opposite to the direction of the moment created by the loads supported by the beams.

As a feature of the invention, the forces urging the consoles apart are transferred along a longitudinal axis of the beams so that the beams has both bending moments and tensile stress due to said forces.

As another feature of the invention, the consoles are urged apart by respective forces for providing a bending moment in the beams that has a substantially parabolic function defined between the ends of the beams.

In a presently preferred embodiment, this invention provides a composite load supported structure capable of storing axial tensiles strain energy. The structure comprises an I-beam having an upper flange, a lower flange, a vertical web interconnecting the flanges, and a longitudinal neutral axis. A plurality of adjacent consoles comprised of concrete slabs are serially disposed parallel to the beam longitudinal axis and secured on the beam upper flange. A plurality of steel shear connectors associated with each console are attached to the beam upper flange and extend onto the console to secure the console to the beam. The shear connectors are adapted for transferring longitudinal stress from the consoles to the beam. A force imparting means is provided for imparting a predetermined longitudinal tensile force externally to pairs of adjacent consoles to induce precompression in the concrete of the consoles. Such precompression induces the shear connectors to transfer at least part of the precompression from the concrete as longitudinal stress to the beam upper flange to store such stress in the beam as axial tensile strain energy.

Preferably, voids existing between the consoles in the urged apart condition are filled with an essentially noncompressible material such as babbitt metal. The babbitt metal is placed in the voids while in a liquid state and upon solidifying, the babbitt metal maintains the consoles in the urged apart condition.

Preferably, the external force is provided by respective jacks, i.e., flat jacks, placed between each of the consoles.

Briefly stated, the method of prestressing the beams includes energizing the hydraulic jacks that are placed between the consoles, each jack applying a predetermined force for providing a bending moment in the beams that has a parabolic function between the ends of the beams. Subsequent to energizing the hydraulic jacks, voids between the slabs are filled with babbitt metal thereby maintaining the consoles in an urged apart condition and a permanent stressing of the beams.

Significantly, an external force is used for creating a permanent stress in the composite structure. Additionally, the forces are applied eccentric to a longitudinal axis of the beams such that both a bending moment and tensile stresses are developed in the beams. The eccentric force is calculated such that the stress on the composite bridge structure as a consequence of such force is compensated partially by the tensile stresses of the "dead load" and partially by the "live load".

BRIEF DESCRIPTION OF THE DRAWINGS

FIG. 8 D is a view of the area between adjacent consoles of FIG. 8C including insulating asbestos surrounding the babbitt metal;

DETAILED DESCRIPTION

Figure 1:
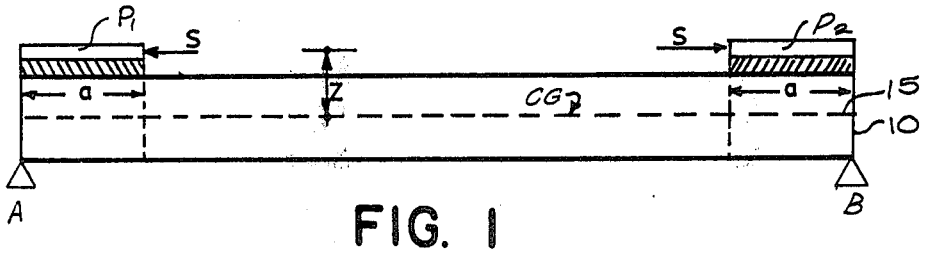
FIG. 1 is a schematic front elevation view of the beams and two consoles according to the invention.

This invention is described in detail with reference to the accompanying drawings. Referring to FIG. 1, there is shown a simple beam 10 supported by supports A and B located at respective ends of the beam. Two consoles $P_1$ and $P_2$ are mounted to the upper surface of the beam at respective ends thereof and are urged apart by a normal force S applied to each console. The force S is applied in a direction parallel to a longitudinal axis 15 that passes through the center of gravity of the beam 10. With the force S applied a distance Z from the longitudinal axis, a bending moment M as a consequence of such force is created in the beam in an amount $M=S\cdot Z$. The bending moment has a constant value at any point in the beam between the consoles and decreases to zero along the console between the point to which the force is applied to the console and the respective end of the beam (see FIG. 2).

Figure 2:
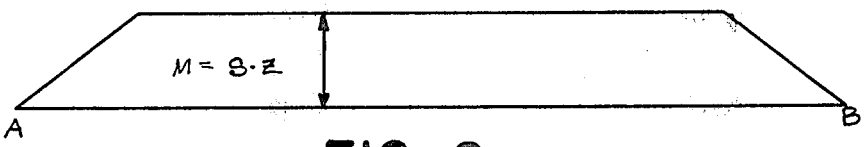
FIG. 2 is a bending moment diagram for the beams as a consequence of forces as applied to the consoles of FIG. 1.
Figure 3:
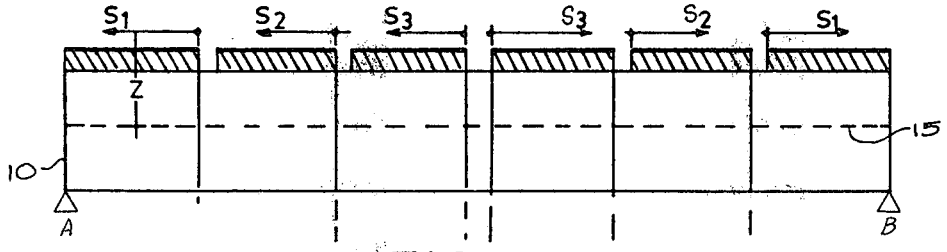
FIG. 3 is a schematic front elevation view of the beams having six consoles urged apart by respective forces according to the invention.
Figure 5:
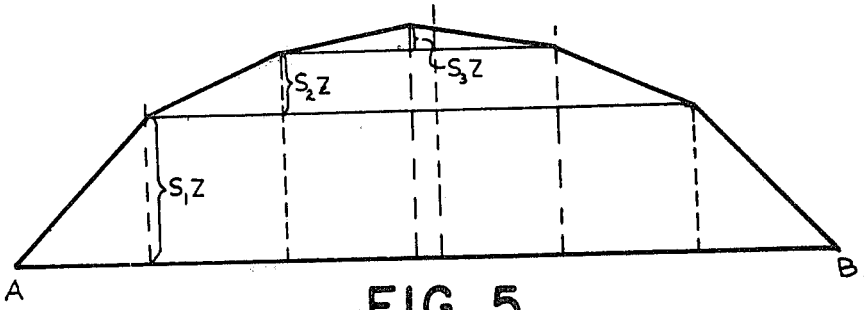
FIG. 5 is a bending moment diagram for the beams resulting from the forces shown in FIG. 4.

Referring to FIG. 3, there is shown a beam having six spaced apart consoles mounted thereto and having respective forces applied to each of the consoles. The forces are in a direction outward from a vertical center of the beam and are in a direction parallel to the longitudinal axis of the beam. When the forces working on the beam are defined by the three forces as shown in FIG. 3, the bending moment distribution on the beam is altered from that as shown in FIG. 2 to a polygonal-shaped distribution as shown in FIG. 5.

Figure 4:
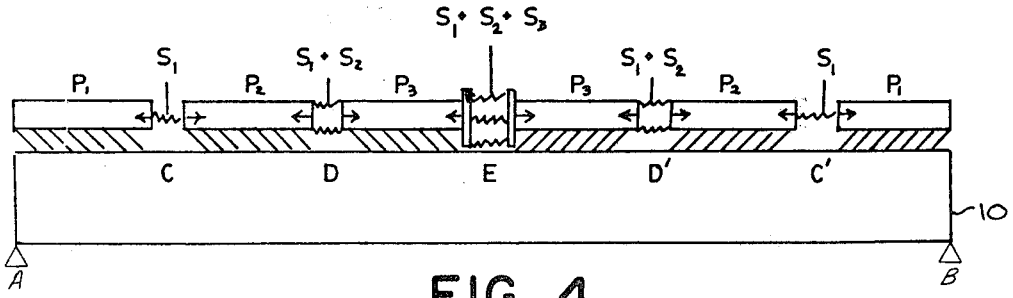
FIG. 4 is a schematic front elevation view of FIG. 3 including springs for representing the resulting forces applied to the consoles.

As shown for example in FIG. 4, three forces work or the beam, namely, force $S_1$ at points C and C', forces $S_1$ and $S_2$ at points D and D' and forces $S_1+S_2+S_3$ at point E. Assuming that $S_1$ is greater than $S_2$, and $S_2$ is greater than $S_3$, a bending moment diagram having a polygonal shape results (see FIG. 5).

Figure 5A:
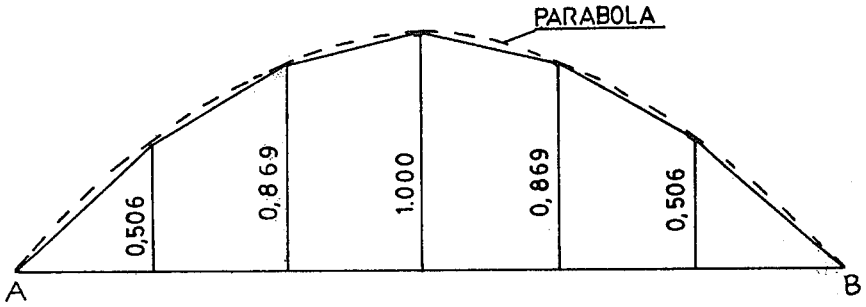
FIG. 5A is a parabolic bending moment diagram for the beams resulting from predetermined forces of FIG. 4.

The forces $S_1$, $S_2$ and $S_3$ may be calculated in such a way that the polygonal-shaped bending moment diagram is defined by a parabolic function (see FIG. 5A). Taking $S_1+S_2+S_3=1/Z$, the respective ordinates representing normalized force values of the bending moment diagram of FIG. 5 are calculated to be 0.506, 0.869 and 1.0 (see FIG. 5A). Thus, selecting a normalized force value of 1.0 for $S_3$, $S_2$ equals 0.869 and $S_1$ equals 0.506. The aforementioned relationship provides the basis for the new and novel composite bridge with precompression.

Figure 6:
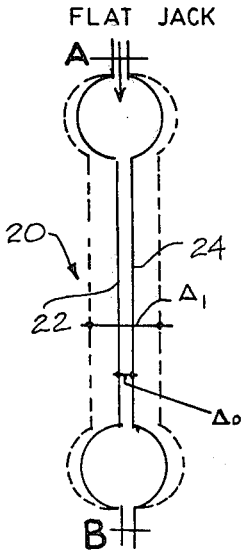
FIG. 6 is a schematic top view of a hydraulic jack, i.e., flat jack.

The forces $S_1$, $S_2$ and $S_3$ are obtained by using individual hydraulic jacks called "flat jacks" placed between adjacent consoles. A flat jack 20 (see FIG. 6) is formed from high tensile strength steel plates forming side walls 22 and 24. The flat jack has an essentially thin cross section for ease of placement between adjacent consoles. The flat jack has an inlet port A and an outlet port B for inletting and discharging hydraulic fluid respectively. In a collapsed state (shown in solid lines in FIG. 6), the distance between the side walls 22 and 24 of the flat jack is shown as $\Delta_0$. Inletting hydraulic liquid at inlet A of the flat jack at a high pressure (about 150 atmospheres) while the exhaust port B is closed, causes the walls of the flat jack to expand to a position $\Delta_1$ (as shown in FIG. 6). The difference between $\Delta_1$ and $\Delta_0$ defines the maximum transverse displacement between the side walls 22 and 24.

Figure 7:
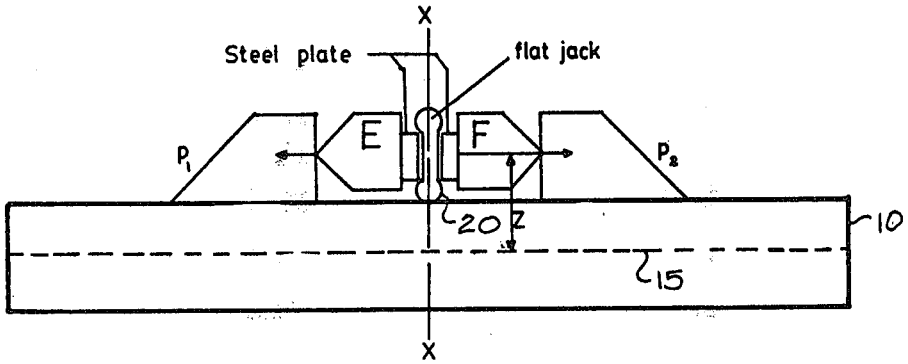
FIG. 7 is a schematic front elevation view of a composite structure according to the invention including a flat jack in place for urging apart two consoles.

Referring to FIG. 7, there is shown a flat jack 20 located in place between two beam-mounted consoles $P_1$ and $P_2$ for applying a force to urge the consoles apart. The force $S_1$ is applied a distance Z away from the longitudinal axis 15 and therefore a distance Z from the center of gravity of the beam and provides thereby a bending moment $M=S\cdot Z$.

Figure 8:
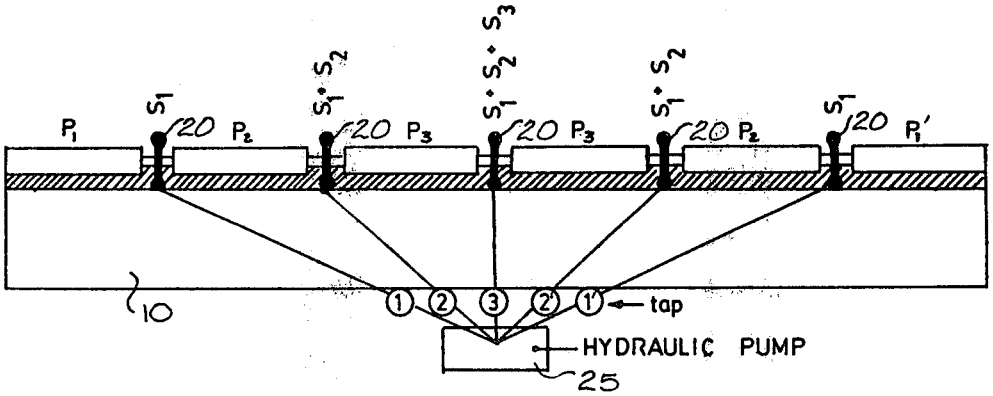
FIG. 8 is a schematic front elevation view of FIG. 3 including flat jacks in place between the consoles.

Referring to FIG. 8, there is shown the beam 10 having six spaced apart consoles $P_1$, $P_2$, $P_3$ and $P_1'$, $P_2'$ and $P_3'$ and secured to the upper surface of the beam such that the beam is divided into six equal lengths. Located between adjacent consoles is a flat jack for urging apart such adjacent consoles. The flat jacks are energized by means of hydraulic pump 25 and the hydraulic liquid flow is controlled by taps 1, 2, 3 and 1' and 2' connected to respective flat jacks.

Figure 8A:
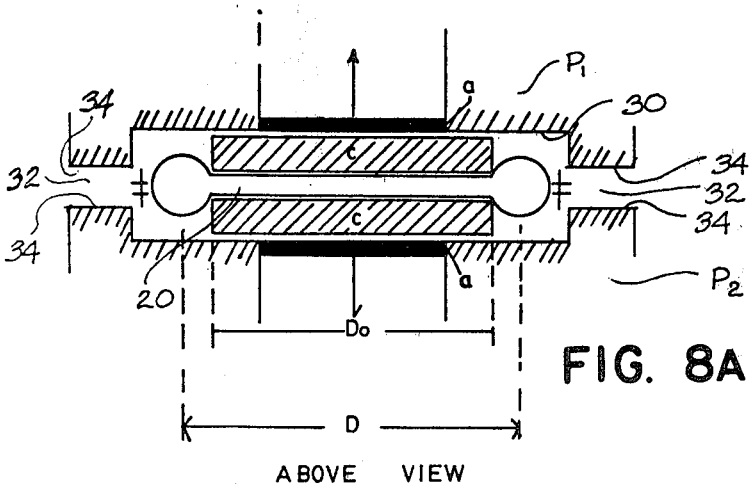
FIG. 8A is an exploded view of an in-place flat jack shown in FIG. 8.

FIG. 8A is an exploded view of the area between consoles $P_1$ and $P_2$ that includes a flat jack 20. A central recess portion 30 of each end of the consoles is inset from the beam and provides a channel within which a flat jack is mounted. The surface of the recess portion 30 of the console end includes a flat plate "a", preferably steel, to form a bearing surface at the end of the console. Located between the flat jack and the plates "a" of adjacent consoles are circular plates "c". The circular plates "c" are preferably formed of steel and have a diameter substantially the same as the length of the walls 22 and 24 of the flat jack. Preferably, the thickness of the circular plates is 20 mm in order to be capable of bearing the bending moments caused by the energized flat jacks.

Referring again to FIG. 8, the method of prestressing the beam is described below. Initially all the taps, i.e., 1, 2, 3, 1' and 2', are opened to provide liquid flow between the hydraulic pump and all the jacks. All of the flat jacks are energized until each provide a force of $S_1$ between adjacent consoles. At such time, taps 1 and 1' are closed thereby preventing further hydraulic liquid flow to the respective jacks. Subsequently, hydraulic liquid is pumped into the remaining three flat jacks until each exert a force of $S_1+S_2$ against the respective consoles. At such time, the taps 2 and 2' are closed. Subsequently, the remaining flat jack is energized so that it exerts a force $S_1+S_2+S_3$ between the two consoles to which it is coupled. Subsequently, the tap 3 is closed, thereby maintaining all the flat jacks in a predetermined energized condition.

The values of forces $S_1$, $S_2$ and $S_3$ are calculated by the method previously described, and thereby completing the process of precompressing the composite structure.

Figure 8B:
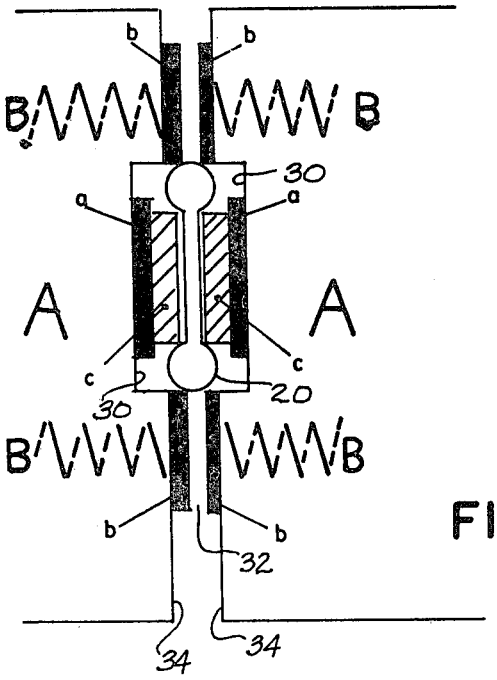
FIG. 8B is an alternate exploded view of a flat jack in-place as shown in FIG. 8.
Figure 8C:
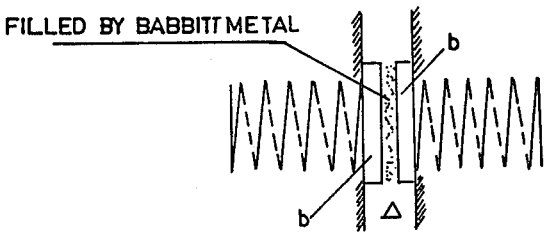
FIG. 8C is a view of the area between adjacent consoles filled with babbitt metal.
Figure 8D:
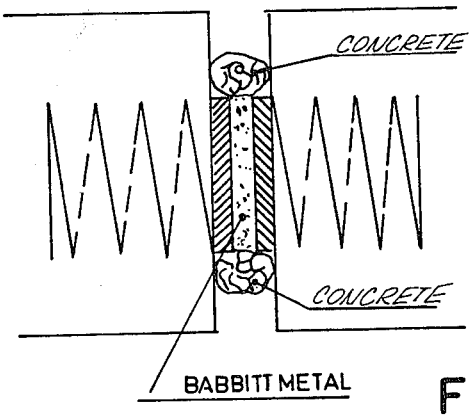

Subsequent to the stressing process, the distance between adjacent consoles resulting from the exertion of force by the flat jacks is maintained by insertion of a substantially non-compressible material such as babbitt metal in a void region 32 between the ends 34 of adjacent consoles. More specifically, and referring to FIG. 8B, there is shown an exploded view of the ends of two consoles urged apart by a flat jack. The ends 34 of the consoles include steel plates "b" located on either side of the flat jack. The steel plates "b" are secured to the consoles by any of a number of conventional securing techniques. Fixing or anchoring adjacent consoles in position relative to each other is defined as an "anchoring process". The anchoring process includes pouring liquid babbitt metal in the region 32 between the steel plates "b" while the flat jacks are in an energized condition. After about 5 minutes, the babbitt metal hardens and becomes substantially incompressible such that the jacks may be deenergized and removed from the reset portion 30 of the ends of the consoles. Subsequent to removal of the flat jacks, the void caused by the removal of such jacks, may be filled with another substantially incompressible material such as concrete. To account for any compression or slip in the babbitt metal or concrete used in the anchoring process, an additional 15% to 20% overstress force is provided by the individual flat jacks over the priorly-calculated forces.

The consoles are preferably formed of concrete and to compensate for any shrinkage and creep in the consoles, the precompression forces exerted by the flat jacks are maintained for approximately 24 hours prior to performing the anchoring process.

Figure 9:
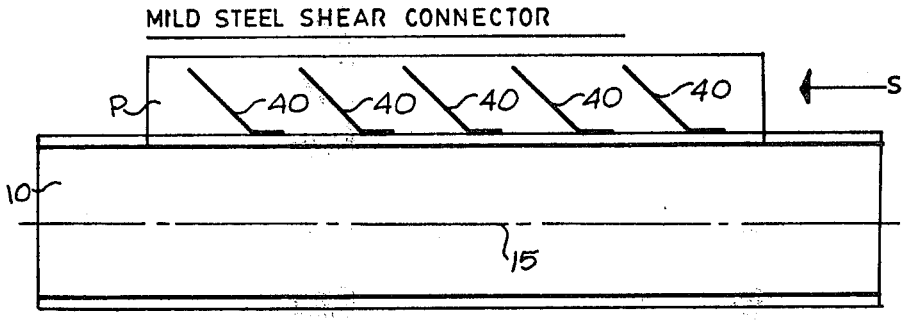
FIG. 9 is a view of a concrete slab console having reinforcing steel shear connectors according to the invention.
Figure 10:
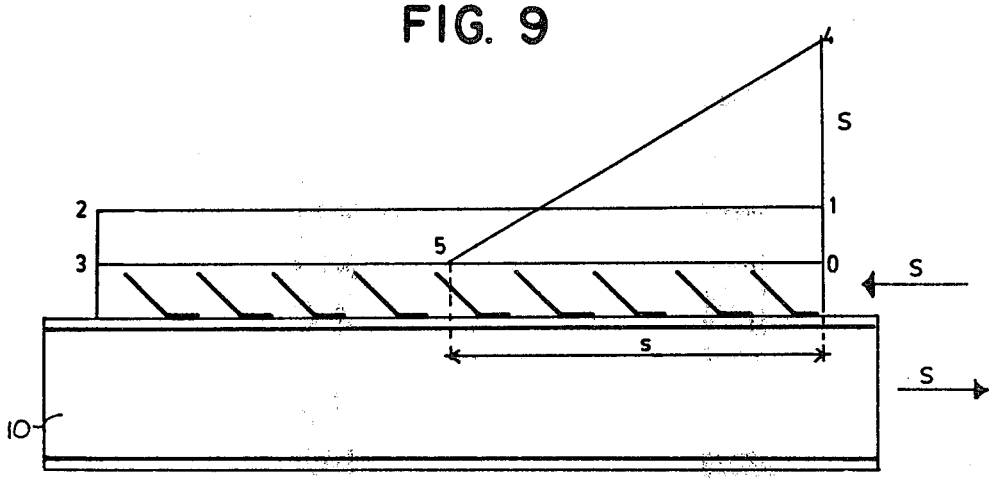
FIG. 10 is a shear force diagram corresponding to the structure shown in FIG. 9.
Figure 11:
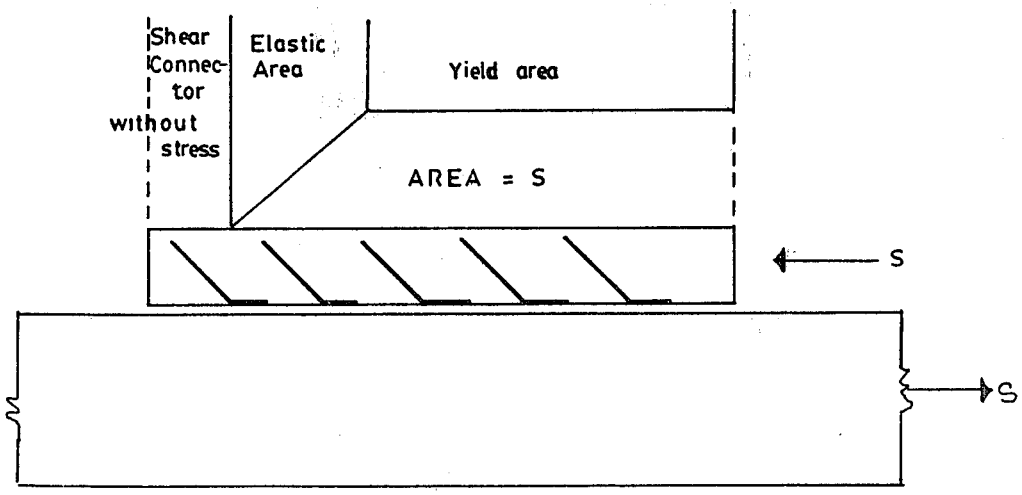
FIG. 11 is a shear force diagram for the shear connectors of FIG. 10 as calculated by the strength of the shear connectors based upon their yield point.

Referring to FIG. 9, there is shown an I-shaped beam 10 upon which is secured a console P formed in a concrete slab having a plurality of reinforcing steel shear connectors 40. Preferably, the shear connectors 40 are secured to the beam 10 by means of welding. The consoles are formed to withstand maximum shear forces provided by the flat jacks. In the case where the tension in the shear connectors reachs the yield point, the shear force along the concrete slab is nearly constant. The strength of the shear connectors may be calculated based on a yield point of about 1,900 Kg cm$^2$ (kilograms per centimeter squared). In the event the shear connectors do not reach the yield point, for example, if the connectors are overdimensioned, the force S will be transferred over a distance as shown in FIG. 10 by the transfer diagram as $\overline{045}$. Optimumly, the transfer diagram is $\overline{0123}$ in which the area of $\overline{0123}$ is the same with the value of force S. By calculating the size of the shear connectors based upon the yield point, the transfer diagram is obtained nearly as shown in FIG. 11.

The precompression force S working on the composite bridge structure is described as follows.

Figure 12:
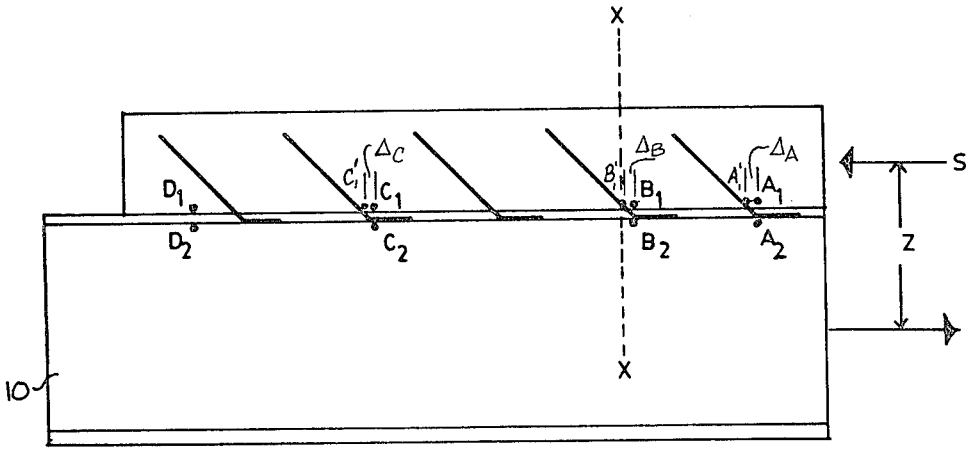
FIG. 12 is a schematic front elevation view of a composite structure having shear connectors according to the invention.
Figure 13A:
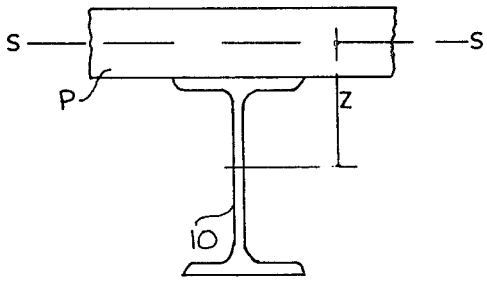
FIG. 13A is a cross-sectional view of a composite structure according to the invention.

Referring to FIG. 12, the force S applied to the concrete slab (console) causes a point $A_1$ on the slab to be displaced $\Delta_A$ to the left of the point $A_1$. The displacement $\Delta_A$ is defined as "slip". Similarly, point $B_1$ on the slab will be displaced an amount $\Delta_B$ to the left. The displacement $\Delta_B$ is also defined as "slip", and $\Delta_B$ is smaller than $\Delta_A$. Accordingly, point $C_1$ on the slab will also have a displacement $\Delta_C$ very small in value and nearly equal to zero. At the last point $D_1$, no displacement occurs. It is thereby considered that the precompression force S is fully borne by the concrete slab. In the case where the beam is I-shaped, the force is transferred to a flange of the beam (see FIG. 13A). Accordingly, tensile force S occurs along the axis of the I-beam, and a negative bending moment MS=S·Z occurs along the cross section of the beam. In transferring the precompression force S on the concrete slab to the flanges of the beam, slip occurs so that the beam and the concrete do not act as a composite structure. However, upon complete transfer and complete keying of the concrete slabs, the slabs and the beams work as a composite section for the "live-load" loading.

Figure 13B:
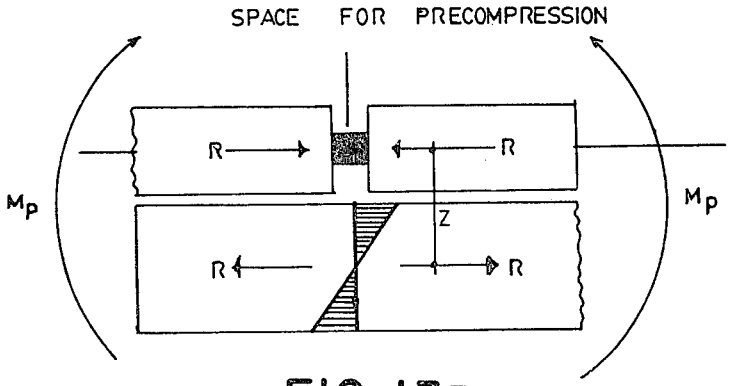
FIG. 13B is a diagram showing a bending moment Mp or the beams as a consequence of a live load on the beams.

At the location of each flat jack, a bending moment Mp as a consequence of the "live-load" loading is borne by the beam. The beam has a moment of inertia $I_0$ about the longitudinal axis and a bending moment R·Z (FIG. 13B) in which R is a force which works on the beam as the result of the bending moment Mp. According to Guldin's Rule, we may write the moment of inertia of the beam cross section to the axis S—S (see FIG. 13A) as follows:

$$I_{SS}=I_0+F_a \cdot Z^2$$

in which:

$I_{SS}$ is the moment of inertia of the cross section with respect to the S—S axis;

$I_0$ is the moment of inertia of the cross section to with respect to the center axis;

$F_a$ is the area of cross section;

Z is the distance from the center of gravity of the cross section of the S—S axis.

The bending moment $M_p$ is partially borne by the beam in an amount of:

$$M_a = \frac{I_O}{I_{SS}} M_P$$

or $$M_a = \frac{I_O}{I_O + F_a \cdot Z^2} \cdot M_P$$

in which $M_a$ is a part of bending moment $M_p$ borne by the beam. The remainder of the bending moment is attributed to the product R·Z so that:

$$M_P = \frac{I_O}{I_O + F_a \cdot Z^2} M_P + R \cdot Z$$

or $$R = \frac{I_O}{I_O + F_a \cdot Z^2} \cdot \frac{M_P}{Z}$$

The stress in the concrete slab and the beam may be calculated as follows. For the concrete slab, the stress is as a result of:

(a) precompression force S in the amount of:

$$\sigma_{b1}=S/F_b$$

in which $F_b$ is the area of the cross section of the concrete slab;

(b) axial force R in the amount:

$$\sigma_{b2}=R/F_b$$

The total stress is obtained by summing $\sigma_{b1}$ and $\sigma_{b2}$ or:

$$\sigma_b=\sigma_{b1}+\sigma_{b2}$$

For the beam, the tensile stress is a result of:

(a) axial force R:

$$\text{thus; } \sigma_{a1}=R/F_a$$

(b) bending moment $M_a$:

$$\text{thus; } \sigma_{a2}=\pm M_a\cdot(Y/I_0)$$

in which $I_0$ is the moment of inertia of the cross section to the longitudinal or center axis;

Y is the distance from the center of gravity of the cross section to the top or bottom of the beam; and $$M_a=(I_0/I_{SS})\cdot M_P$$

Furthermore, the total tensile stress in the beam is obtained by the appropriate summation of $\sigma_{A1}$ and $\sigma_{A2}$. Thus, at the top of the beam, the total tensile stress is:

$$\sigma_{aa}=\frac{R}{F_a}-\frac{M_a\cdot Y_a}{I_O}$$

in which $Y_a$ is the distance from the center of the cross section to the top of the beam; and at the bottom of the beam, the total tensile stress in the amount of:

$$\sigma_{ab}=\frac{R}{F_a}+\frac{M_a\cdot Y_b}{I_O}$$

in which $Y_b$ is the distance from the center of gravity of the cross section to the bottom of the beam.

The tensile stress in the composite structure cross section may be observed as a consequence of several loadings, namely, the "dead load", the precompression force, the "live load" only and the total load.

Figure 14:
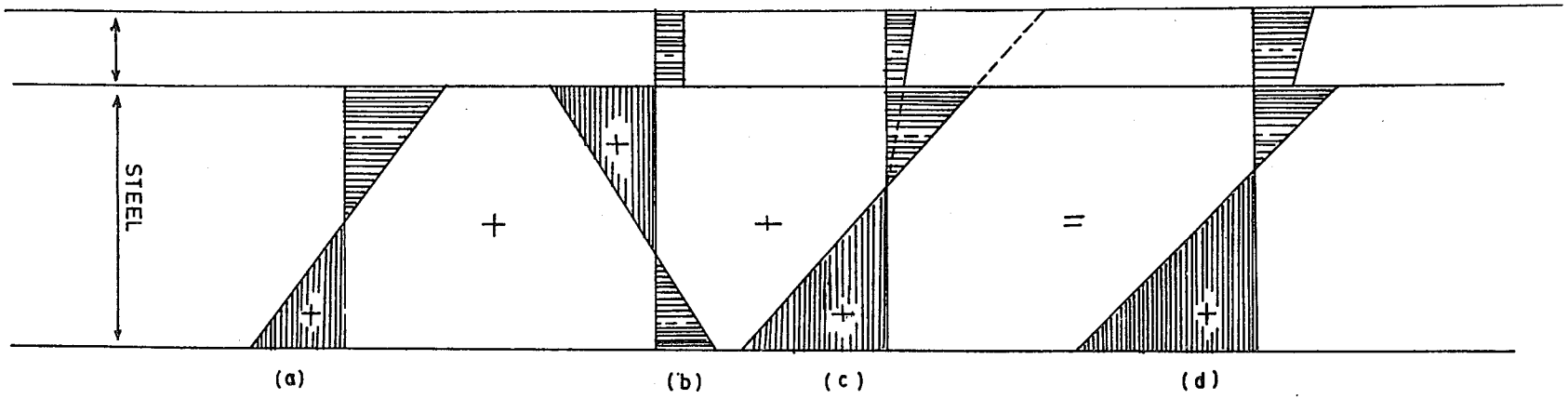
FIG. 14 is a stress diagram relating to the beams for various types of loading at points a, b, c and d of the beams. At point "a", the stress diagram relates to the beams load of its own weight and the weight of a concrete console slab. At point "b", the stress diagram relates to the cross section of the composite structure affected by only a precompression force. At point "c", the stress diagram relates to the cross section of the composite structure affected by only the live load. At point "d", the stress diagram relates to the cross section of the composite structure affected by the superposition of the stress diagrams at points a, b and c.

FIG. 14*a* shows a stress diagram in the cross section of the beam caused by the "dead load" which includes the beam weight and the weight of the concrete slab. FIG. 14*b* shows the stress diagram in the cross section of the composite structure by the precompression force only. FIG. 14*c* shows the stress diagram in the cross section of the composite structure by the "live load" only. FIG. 14*d* shows a total stress diagram working on the cross section of the composite structure by the superposition of the above described stress diagrams of FIG. 14. It is observed that a precompression system designed according to the principles herein described is able to increase the efficiency of a bridge structure.

The economical considerations of this new composite structure may be described as follows.

An elastic structure may be compared with a reservoir of strain energy. The more "specific energy" (energy per unit volume) that can be stored in the material of the elastic structure, the more economical the structure will be. There are two kinds of strain energy which will be discussed below.

Figure 15:
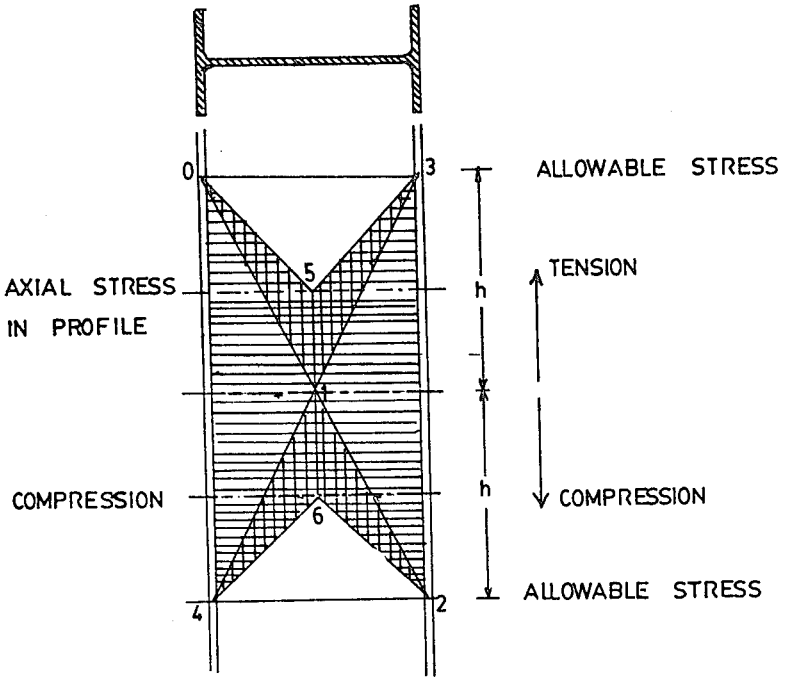
FIG. 15 is a strain energy storage diagram relating to the beams.

First, the bending strain energy and second the tensile strain energy. In a normal composite structure, only bending strain energy can be stored in the material. In the composite structure of this invention with precompression, the beam or beams receives an axial tensile force in the same amount with the compressive force exerted on a concrete slab. Consequently, the beam is stretched and bent and stores thereby, tensile and bending strain energy. This phenomena is shown graphically in FIG. 15. The area $\overline{0140}+\overline{3123}$ represents the maixmum bending strain energy (bending strain energy and tensile strain energy) which can be stored in the new system. Thus, the additional area $\overline{05310}+\overline{26412}$ represents the additional energy as a consequence of tensile strain. Thus, it is clear that the new composite bridge structure is more economical when compared to the prior art.

While the basic principle of this invention has been herein illustrated along with one embodiment, it will be appreciated by those skilled in the art that variations in the disclosed arrangement both as to its details and as to the organization of such details may be made without departing from the spirit and scope thereof. Accordingly, it is intended that the foregoing disclosure and the showings made in the drawings will be considered only as illustrative of the principles of the invention and not construed in a limiting sense.

What is claimed is:

1. A composite bridge structure having a beam for supporting loads thereon, the bridge structure comprising a plurality of spaced apart concrete consoles secured to the beam, the consoles located on the beam and being urged apart for creating a bending moment in the beam in a direction opposite to the direction of the moment created by the load supported by the beam.

2. The composite bridge structure of claim 1 wherein the consoles are adapted for transferring the forces urging the consoles apart to tensile forces along a longitudinal axis of the beam so that the beam has both bending moments and tensile strain due to said forces.

3. The composite bridge structure of claim 2 wherein any tensile stress in the beam is increased an amount in relation to the total forces urging the consoles apart.

4. A composite load-supporting structure comprising:

a beam for supporting loads thereon, the beam having two ends and upper and lower surfaces;

a plurality of consoles comprising concrete slabs;

means for securing the consoles to the upper surface of the beam in spaced apart relationship between the two ends of the beam; and means for urging the consoles a part to provide a bending moment in the beam that has a substantially parabolic distribution between the ends of the beam in a direction opposite to the direction of the moment created by loads supported by the beam.

5. The composite structure of claim 4 wherein the beam is formed of steel.

6. The composite structure of claim 5 wherein the securing means comprises shear connectors each having one portion attached to the upper surface of the beam and another portion embedded in one of the concrete slabs.

7. The composite structure of claim 6 wherein the urging means comprises steel plates bearing against adjacent consoles and babbitt metal filling the space between the plates.

8. The composite structure of claim 7 wherein the consoles are all of equal length.

9. A method of prestressing a composite structure comprising a beam having two ends, said beam having a plurality of spaced apart consoles secured to said beam between the ends thereof, the method comprising the steps of:

urging apart the consoles to create a bending moment in the beam in a direction opposite to load-produced bending moments; and while the consoles are urged apart, filling voids between adjacent consoles with essentially non-compressible material for maintaining the consoles in the urged apart condition.

10. The method of claim 9 wherein the step of urging apart the consoles comprises:

sequentially urging apart the consoles by respective forces, starting from the consoles located at the ends of the beam and progressing inwardly towards the center of the beam to provide a bending moment that has a substantially parabolic function defined between the ends of the beam.

11. The method of claim 9 wherein the step of filling the voids between adjacent consoles comprises the step of filling the voids with babbitt metal.

12. A composite load supporting structure capable of storing axial tensile strain energy comprising:

an I-beam having an upper flange, a lower flange, a vertical web interconnecting the flanges, and a longitudinal neutral axis;

a plurality of adjacent consoles comprising concrete slabs, the consoles being serially disposed parallel to the beam longitudinal axis and secured on the beam upper flange;

a plurality of steel shear connectors associated with each console and attached to the beam upper flange and extending into the console to secure the console to the beam, the shear connectors being adapted for transferring longitudinal stress from the consoles to the beam; and force imparting means for imparting a predetermined longitudinal tensile force externally to pairs of adjacent consoles to induce precompression in the concrete of the consoles, whereby the shear connectors transfer at least part of the precompression from the concrete as longitudinal stress to the beam upper flange to store such stress in the beam as axial tensile strain energy.

13. A composite structure according to claim 12 wherein the shear connectors transfer at least part of the remainder of the precompression to the beam to provide a negative bending moment in the beam to store stress in the beam as bending strain energy.

14. A composite structure according to claim 12 wherein the extension of the shear connectors into the consoles defines an included angle of about 45° with the beam upper flange.

15. A composite structure according to claim 12 wherein the magnitude of force externally imparted to any given pair of adjacent consoles is cooperatively related to the magnitude of force externally imparted to all remaining pairs of adjacent consoles to provide a negative bending moment in the beam that has a substantially parabolic distribution along the beam longitudinal axis.

16. A composite structure according to claim 15 wherein the negative bending moment is at least as large as that positive moment induced in the beam by the dead weight mass of the composite structure.

17. A composite structure according to claim 12 wherein the force imparting means comprises a plurality of hydraulic flat jacks, each such jack for providing said predetermined tensile stress between an associated pair of adjacent consoles to urge apart the consoles along the beam longitudinal axis whereby the precompression is induced in the concrete, and an essentially incompressible material for filling voids between the urged apart consoles for maintaining precompression in the concrete without reference to the flat jacks.

18. A composite structure according to claim 17 wherein the essentially incompressible material comprises babbitt metal.

19. A composite structure according to claim 18 wherein the consoles further comprise a vertical end face associated with each respective adjacent console, and steel plate bearing fixed on each such vertical end face for receiving molten babbitt metal poured in the voids between the urged apart consoles.

20. A composite structure according to claim 12 wherein the concrete consoles are substantially of equal length along the beam longitudinal axis.

21. A composite structure according to claim 12 which is a structural member component of a bridge structure.

* * * * *